US006910430B1

(12) United States Patent
Chou et al.

(10) Patent No.: US 6,910,430 B1
(45) Date of Patent: Jun. 28, 2005

(54) RESOURCES RECLAIMING APPARATUS

(75) Inventors: Yao-Nan Chou, Tainan (TW); Min-Hsien Hsieh, Kaohsiung (TW)

(73) Assignee: Yao-Nan Chuo, Tainan (TW)

( * ) Notice: Subject to any disclaimer, the term of this patent is extended or adjusted under 35 U.S.C. 154(b) by 0 days.

(21) Appl. No.: 10/778,401

(22) Filed: Feb. 17, 2004

(51) Int. Cl.[7] ..... F23B 5/00; F23J 1/00; F23G 7/06

(52) U.S. Cl. ..... 110/208; 110/213; 110/295; 110/318; 110/101 R; 110/165 R

(58) Field of Search ..... 110/228, 208, 213, 110/210, 211, 235, 295, 296, 293, 317, 318, 110/331, 332, 101 R, 111, 112, 113, 114, 110/115, 165 R

(56) References Cited

U.S. PATENT DOCUMENTS 3,561,377 A * 2/1971 Amundsen ..... 110/190
3,875,874 A * 4/1975 Altmann ..... 110/213
4,579,067 A * 4/1986 Peters ..... 110/235

* cited by examiner

*Primary Examiner*—Kenneth Rinehart
(74) *Attorney, Agent, or Firm*—Birch, Stewart, Kolasch & Birch, LLP

(57) ABSTRACT

A resources reclaiming apparatus includes a furnace having an interior spacer. The spacer has one end forming an arched section with a distal end tilted upwards forming a sloped section extruded to form a plane spacer having a firing port therein, thereby dividing the furnace into first and second combustion chambers. The furnace has intake ports located on the right side abutting an upper end of the furnace and air ducts atop intake ports. The air ducts have one end extending into an end of a scattering and dispensing chamber. Materials convey to the scattering and dispensing chamber and dispense to the combustion chamber of the furnace through the air ducts to burn at high temperatures for molting. Fire channels to the arched and sloped sections of the spacer directed upwards to circulate and lengthen burning period. Thereby hazardous materials decompose and vitrify for storing.

2 Claims, 6 Drawing Sheets

RESOURCES RECLAIMING APPARATUS

FIELD OF THE INVENTION

The present invention relates to a resources reclaiming apparatus and particularly to an apparatus for rapidly decomposing and vitrifying hazardous materials to become nontoxic.

BACKGROUND OF THE INVENTION

Presently Taiwan generates a great amount of daily waste such as ashes, industrial discarded soils, industrial wastes, discarded solid materials, waste oil, waste solution, discarded liquid, sludge, other liquid type wastes, etc. On the other hand, gravel used in construction projects is generally made by crushing stones and rocks excavated from rivers or mountains. They are called natural gravel for building bridges and roads and used as fillers in the civil engineering and construction projects to increase the strength and rigidity of reinforced concrete or asphalt roads. As the natural gravel is excavated from nature, their surfaces are contaminated with organic substances and bacteria. As a result, corrosion often occurs to the asphalt road surface that contains gravel, and the asphalt road surface tends to crack and damage. Moreover, natural gravel has different compositions. After crushing to a small rock fragments, the inner tissue is destroyed and the strength decreases significantly. This also reduces the pressure resistance and loading power of the concrete structure and shortens the service life. This is a big drawback of natural gravel. Furthermore, with increasing awareness of environmental protection and conservation, excavating the rivers to get the natural gravel often results in loss of soil, unbalances the ecosystem, and causes serious damage to the natural environment, thus it is neither sustainable nor commendable in the long run.

In addition, with the fast progress of industrial and commercial developments, and increased living standards, a great deal of advanced products has been produced to meet people's requirements. These products often involve complicated manufacturing processes and generate a great amount of waste. This waste has become a serious threat to the environment. Hence processing discarded soil and industrial wastes has become an important and urgent issue. Otherwise as industry and commerce thrives, the environment rapidly deteriorates.

Therefore to produce an environment-friendly building material and recycle hazardous ashes, slag, industrial wastes, discarded soils, discarded solid materials, waste oil, waste solution, discarded liquid, sludge, other liquid type wastes and the like to become reusable products that have economic value so that the resources may be reclaimed, and second preventing a public hazard has become a highly pursued goal for nearly every country around the world. This issue is especially prevalent in Taiwan because of the increased awareness of environmental protection and new environmental protection regulations. Moreover, the general public has a great aversion toward treatment of hazardous industrial wastes, ashes, discarded soil (sludge), and land resource is limited, to locate desired landfill is increasingly difficult, and hazardous wastes are not permitted to be dumped in landfill sites. Some wastes such as industrial wastes, ashes, and discarded soil (sludge) are contaminated with hazardous heavy metal and dioxins, they are very difficult to treat and handle.

The conventional treatment approach for hazardous ashes, industrial wastes, discarded soil (sludge) generally is to dump into a landfill or incinerate to reduce volume and weight. Disposing industrial wastes and discarded soil without a thorough plan, or simply dumping ashes and slag into landfills will result in harmful substances seeping underground polluting water. To use slag as road material, sea barrier and building concrete will generate toxic dust when the road and building are cutaway or damaged because the hazardous materials are usually permanent heavy metal, or dioxins and polychlorinated biphenyl. Discarding of construction, industrial wastes and soils often creates a second public hazard. It causes an environmental pollution that has harmful effect to human health. Hence discarding or dumping the wastes into landfills cannot thoroughly resolve the problem. Residual dioxins in the ashes produced by the incinerators are also difficult to treat and handle. All these problems remain to be overcome.

SUMMARY OF THE INVENTION

Therefore the present invention aims to provide a resource reclaiming apparatus to solve the serious problem of processing dioxins and heavy metal pollution. The invention, aside from sintering waste materials and discarded soils, also can transform and reclaim the wastes to become environment-friendly gravel and building material. High temperature waste gases are channeled to a thermal reclaiming device through a smoke duct to process hazardous materials so that the hazardous materials may be decomposed and vitrifying for storing.

In one aspect, the apparatus according to the invention delivers filtered diesel fuel to a pump for compression and transfers the fuel to a throttle valve; then delivers the fuel to an inlet of a combustion device through a piping system; the fuel is indirectly heated in the combustion device and sent to a nozzle; then is atomized through a helical means to be mixed with the heated air in the combustion device; a vortex is generated through a firing nozzle and a fire-resistant structure in a combustion chamber of the furnace; a circulating mixing is performed continuously to generate evenly high temperature so that the materials are melted and discharged through a duct on one side of the furnace to become the environment-friendly gravel and building material.

The invention provides the following features and advantages:

1. The invention has air ducts extending into a scattering and dispensing chamber at one end on one side so that materials are fed into the mixing and dispensing chamber through a helical feeding device at the bottom of a mixing and dispensing chamber. The air ducts can blow and scatter the materials to facilitate burning.
2. The invention recycles the heated gas to scatter dusts and ashes so that they are easier to be decomposed under heat and melted. It also can replenish the air in the furnace without absorbing heat or lowering the temperature.
3. The invention includes a second combustion chamber in the furnace that has a concave upper wall in the interior to increase the strength of the furnace. During burning at high temperature, an arched vortex is formed in the furnace to lengthen the burning time, and result in a higher temperature at the bottom to be discharged through an outlet. The upper section of the second combustion chamber may generate a higher temperature, and the higher temperature is circulated. High temperature exhaust gas is discharged through a discharge duct to allow the ashes to be decomposed and vitrifying.

4. The invention can produce gravel and building material after sintering. The reclaimed man-made gravel and building material have high value. And second pollution may also be prevented.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
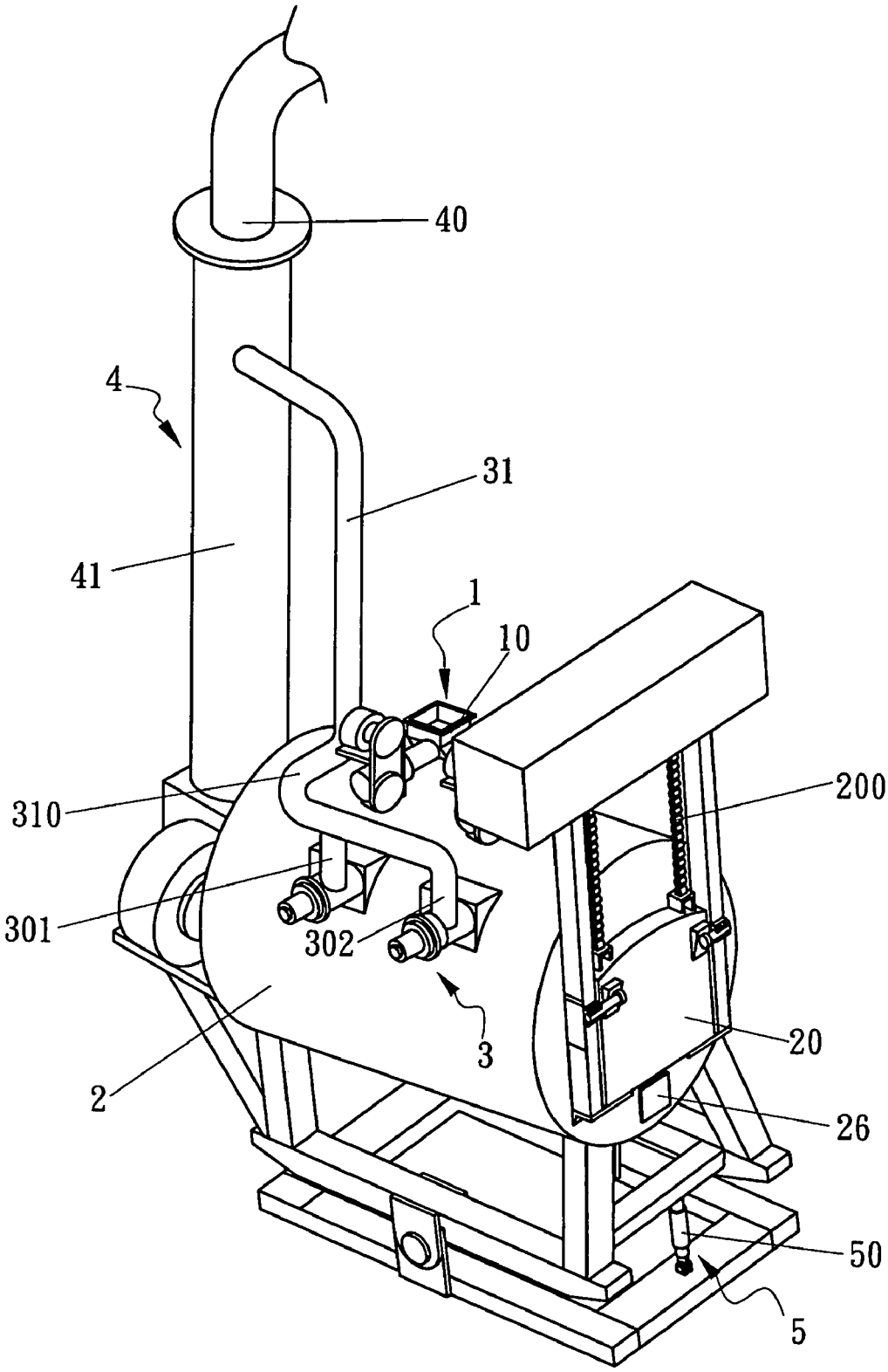
FIG. 1 is a perspective view of the present invention.

Referring to FIG. 1, the resources reclaiming apparatus according to the invention mainly includes a material feeding device 1, a furnace 2, a combustion device 3, a thermal reclaim device 4 and a discharge device 5.

Figure 2:
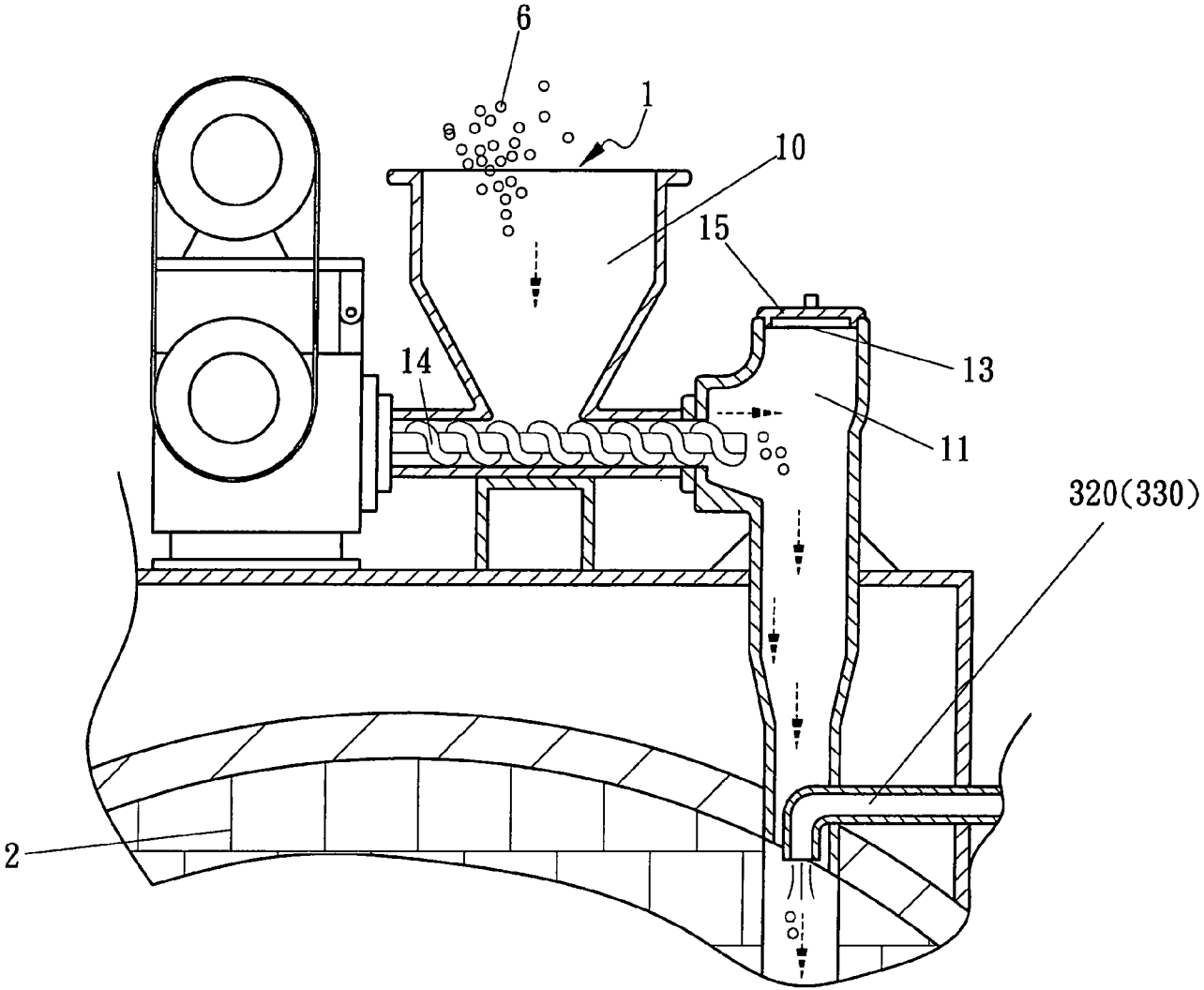
FIG. 2 is a schematic view of the present invention showing the feeding device scatters the feeding material.
Figure 3B:
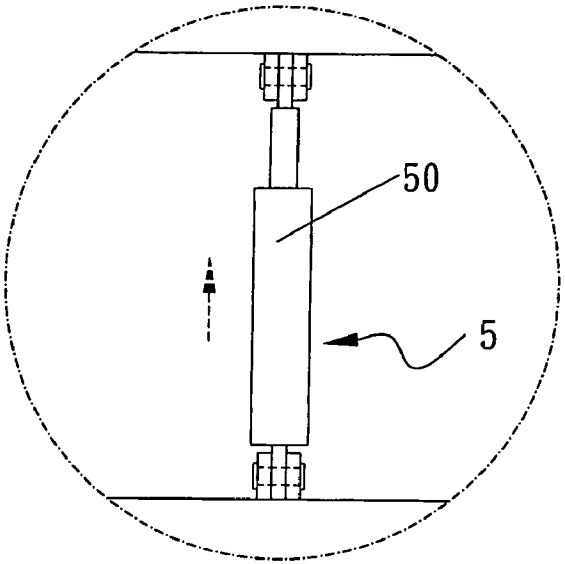
FIG. 3B is a schematic enlarged view of the discharge device of the present invention.
Figure 3A:
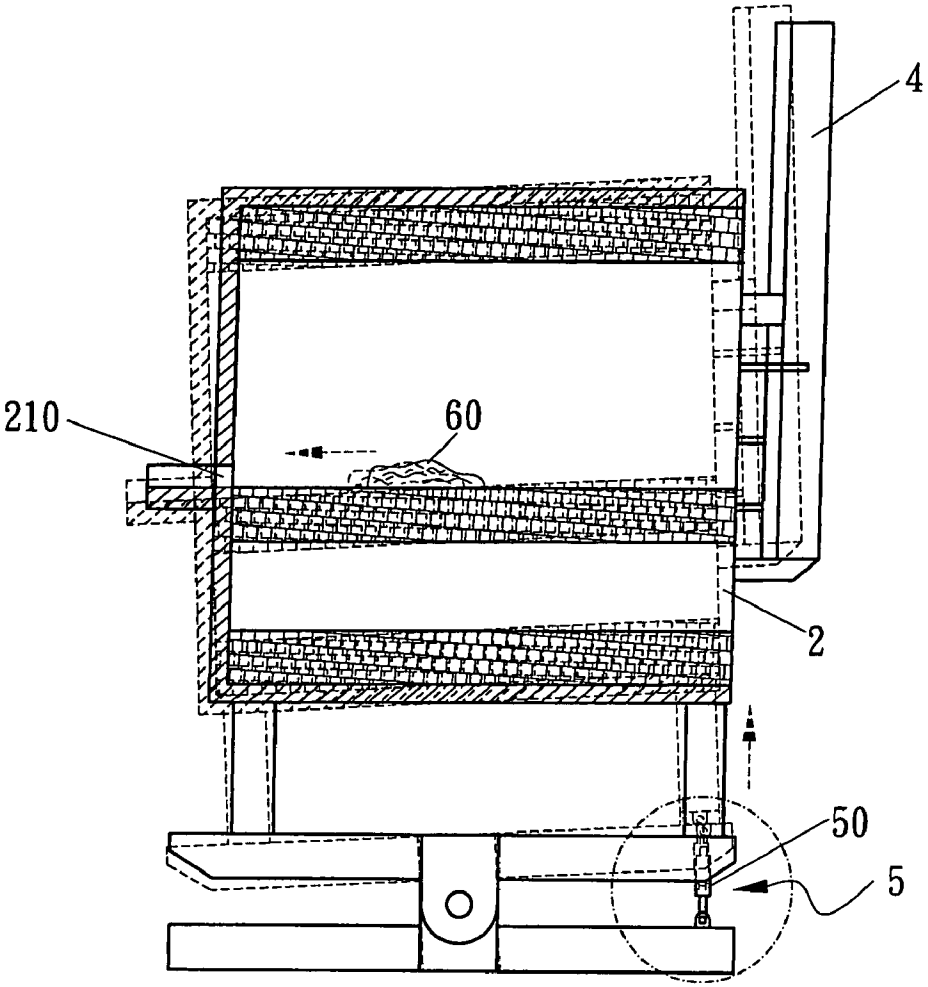
FIG. 3A is a schematic view of the present invention showing the discharge device being adjusted for discharging molten material.
Figure 4:
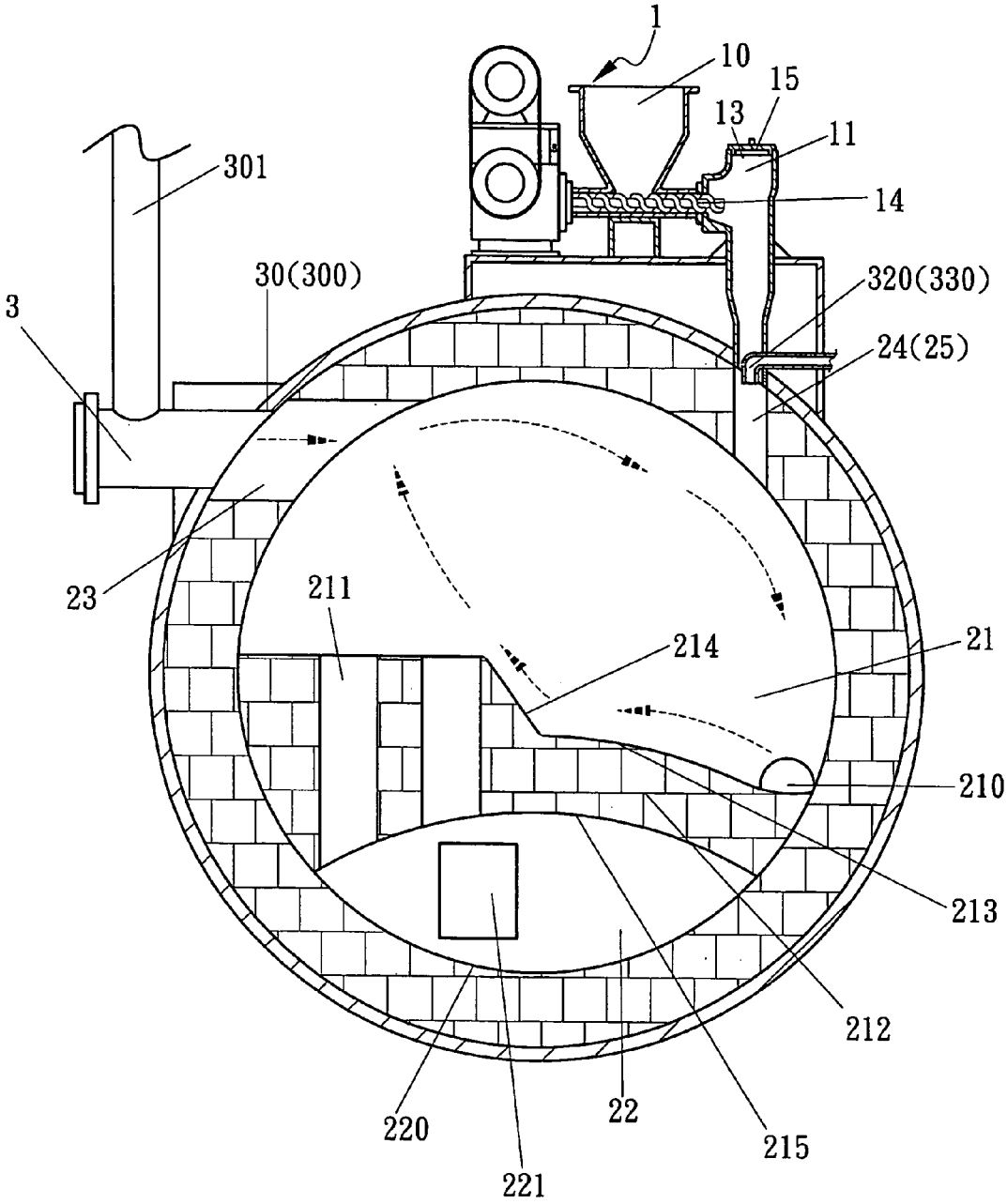
FIG. 4 is a schematic view of the invention showing fire vortex formed inside the combustion chamber of the furnace.

The material feeding device 1 is located above the furnace 2. It has a mixing and dispensing chamber 10 located at an upper side. On one side of the mixing and dispensing chamber 10, there is a scattering and dispensing chamber 11 which has a viewing port 13 on an upper end and is covered by an upper lid 15. At the bottom of the mixing and dispensing chamber 10, there is a helical feeding device 14. The scattering and dispensing chamber 11 has intake ports 24 and 25 at the bottom on the right side of the furnace 2 abutting the top end thereof (referring to FIGS. 2 and 4).

Figure 5:
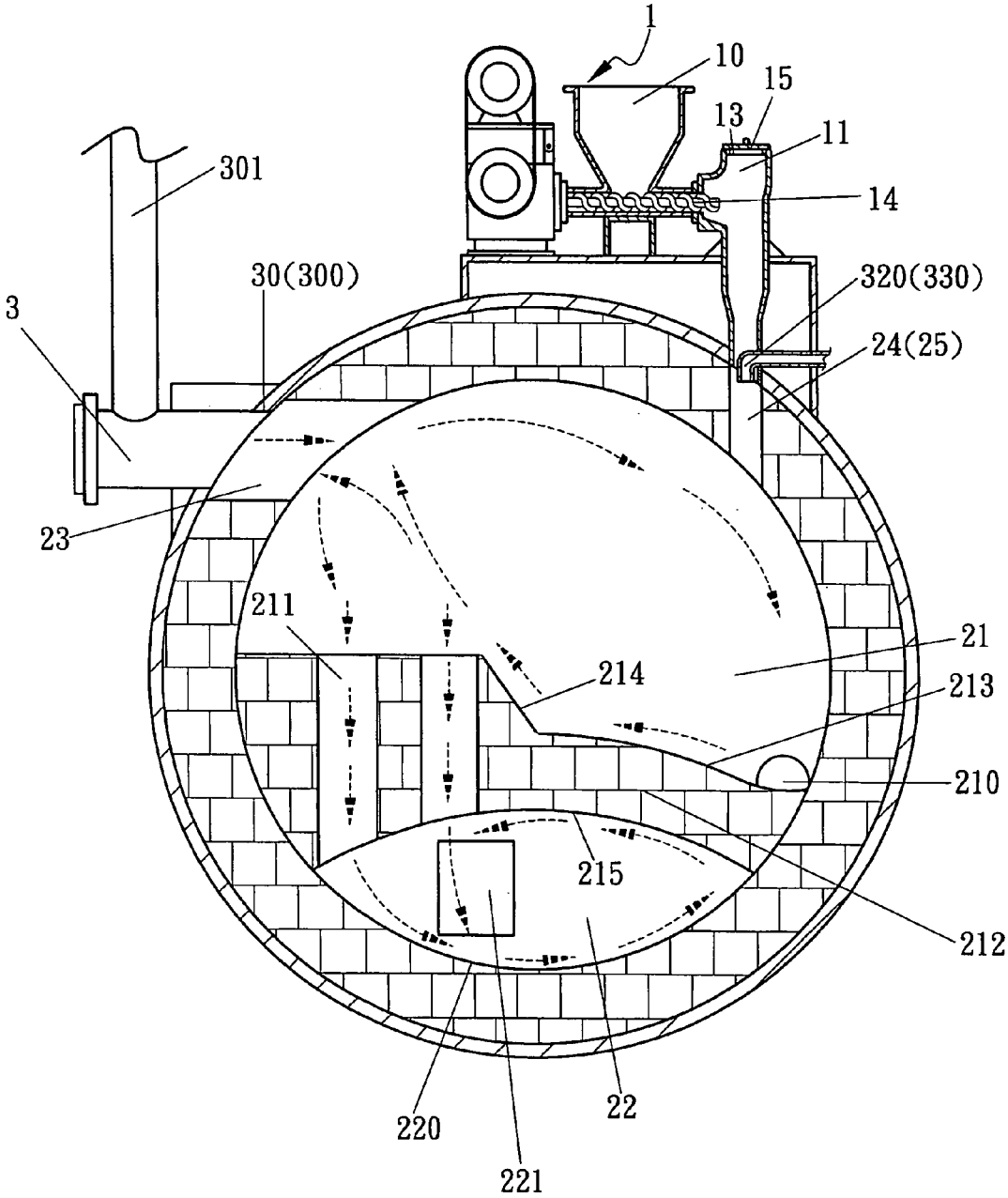
FIG. 5 is a schematic view of the invention showing fire vortex formed inside the combustion chamber and the second combustion chamber of the furnace.
Figure 6:
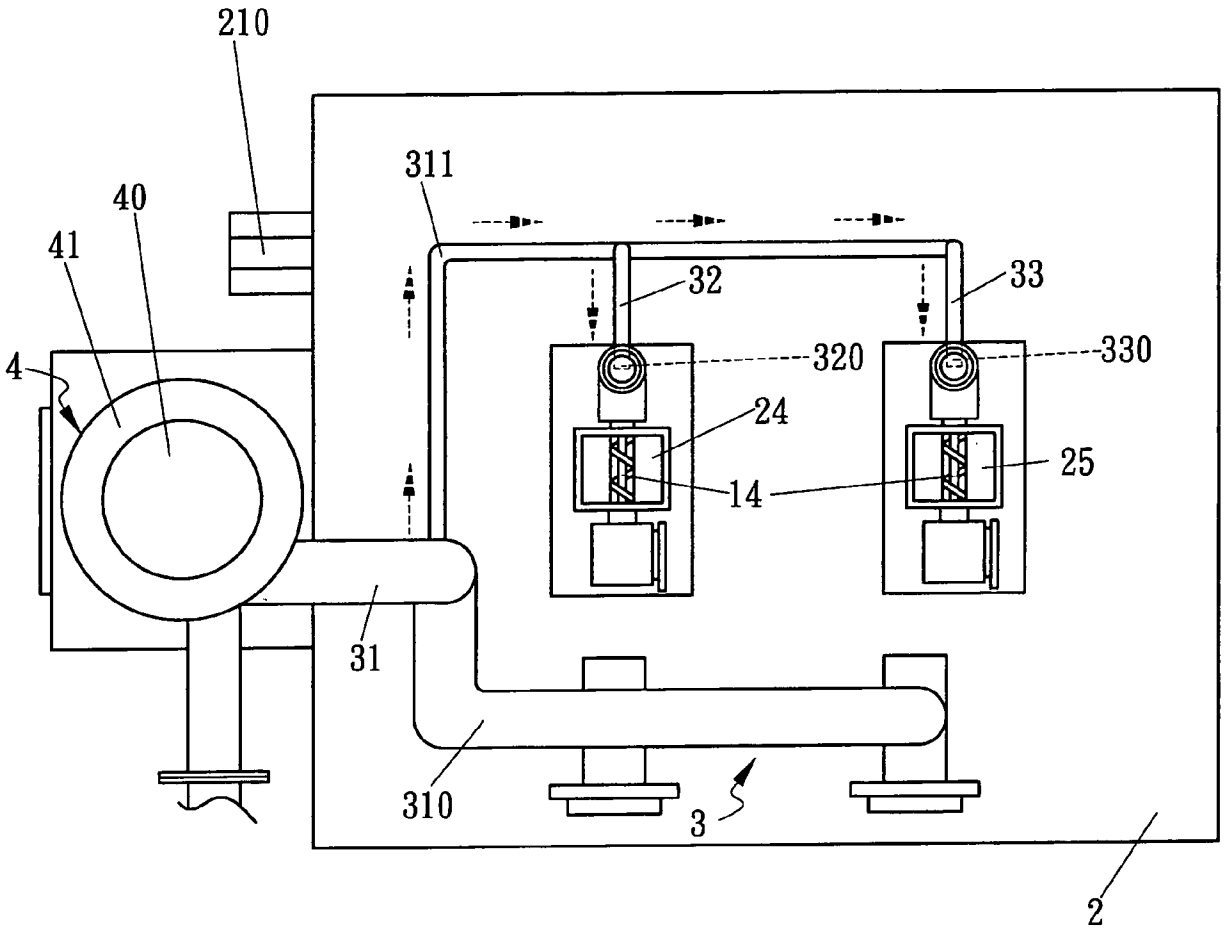
FIG. 6 is a schematic top view of the invention showing heated air distribution of the thermal reclaim device.

The furnace 2 is a cylindrical barrel located below the material feeding device 1 and connects to the scattering and dispensing chamber 11. It has a furnace door 20 at one end movable by a pair of chains 200 in a synchronous manner. The furnace door 20 may be opened to see the burning condition of a combustion chamber 21 located on one side of the interior thereof. The discharge device 5 is equipped with an oil pressure cylinder 50 and located at the bottom of one end of the furnace 2 (referring to FIGS. 1, 2, 3A and 3B). The combustion device 3 is located on one side of the furnace 2, and the thermal reclaim device 4 is located at the front end of the furnace 2. In the interior of the furnace 2, there is an arched spacer 212 on one side. The spacer 212 has one end forming an arched section 213 which has a distal end forming a sloped section 214 directing upwards. The sloped section 214 has one end extended outwards to form a plane spacer which has a firing port 211. The spacer 212 has a concave bottom surface 215. The spacer 212 divides the furnace 2 into the combustion chamber 21 and a second combustion chamber 22. The combustion chamber 21 has a duct 210 at the bottom leading to outside of the furnace 2. The second combustion chamber 22 is located at the bottom of the combustion chamber 21 (referring to FIGS. 4 and 5). The second combustion chamber 22 has an ellipsoidal chamber 220 formed by the concave bottom surface 215 that can enhance the sturdiness of the combustion chamber 21 and the second combustion chamber 22. In addition, there is a gas discharge chamber 221 formed on the inner wall outside the second combustion chamber 22. The gas discharge chamber 221 communicates with a discharge duct 40 of the thermal reclaim device 4. The intake ports 24 and 25 are located on the right side of the upper end of the furnace 2, and there is a port 23 formed on the left side at the upper end of the furnace 2. The port 23 communicates with inlets 30 and 300 of branch ducts 301 and 302 of the combustion device 3. There are air ducts 320 and 330 above the intake ports 24 and 25 that are connected to one side of one end of the scattering and dispensing chamber 11.

The combustion device 3 is located on one side of the furnace 2 and has the inlets 30 and 300 formed on an inner wall to communicate with the port 23 on the left side of the furnace 2. The combustion device 3 is connected to a pipe 31 which further connects to a thermal reclaim duct 41 of the thermal reclaim device 4. The pipe 31 has elbow tubes 310 and 311 on two sides. The elbow tube 310 has one end connecting to the branch ducts 301 and 302. Another elbow tube 311 has one end connecting to branch ducts 32 and 33. The branch ducts 32 and 33 have air ducts 320 and 330 communicating with the intake ports 24 and 25 on the right side of the upper end of the furnace 2.

The thermal reclaim device 4 is located at the front end of the furnace 2 with the gas discharge duct 40 located therein. The gas discharge duct 40 is connected to the thermal reclaim duct 41 which has one side connecting to the pipe 31. The gas discharge duct 40 is also connected to an external air treatment apparatus.

The discharge device 5 is located at the bottom of one end of the furnace 2. It is driven by the oil pressure cylinder 50. Depending on waste and soil types burned in the furnace 2, the furnace 2 may be adjusted and tilted at a selected angle (referring to FIGS. 3A and 3B). By means of the construction set forth above, a complete resource reclaiming apparatus is formed. To manufacture environment-friendly gravel and building material refer to FIGS. 2 through 6. The process is as follows:

1. The mixing and dispensing chamber 10 of the material feeding device 1 transports materials 6 (wastes and soils) which are conveyed by the helical feeding device 14 at the bottom of the mixing and dispensing chamber 10, and scattered in the scattering and dispensing chamber 11. The air ducts 320 and 330 can rapidly blow the materials 6 into the combustion chamber 21 of the furnace 2 (referring to FIGS. 2 and 6). The materials 6 are heated at high temperature and melted in a desired condition. Depending on the materials 6 (wastes and soils), the oil pressure cylinder 50 of the discharge device 5 may be actuated to adjust the tilting angle of the furnace 2 (referring to FIGS. 3A and 3B).
2. When the combustion chamber 21 of the tilted furnace 2 is burning, cool air is fed by a high pressure fan on one side of the furnace 2 and heated by the thermal reclaim device 4 through the smoke stack, and conveyed to the inlet 30 to be mixed with diesel fuel through a helical blender.
3. The diesel fuel is filtered and pumped to a throttle valve, and delivered through the pipe 31 to the inlet 30 of the combustion device 3, and indirectly heated therein and transferred to a nozzle to be atomized and mixed with air in the combustion device 3 for burning. The fire (indicated by arrows in FIG. 4) moves along the arched section 213 and sloped section 214 of the spacer 212, and continues upwards to generate circulation, and enters the second combustion chamber 22 through the fire port 211. Fire in the second combustion chamber 22 not only absorbs the high temperature of the spacer 212, also generates a vortex (referring to FIG. 5) that continuously forms circulation and mixing to produce an even high temperature so that the materials 6 are melted 60 and flow out through the duct 210 on one side of the furnace 2 (referring to FIGS. 3A and 3B) to become environment-friendly gravel and building material. Exhaust gas after high temperature burning passes through the thermal reclaim device 4 through a smoke stack, and is processed by the air treatment apparatus to become clean and non-hazardous condition to be discharged through the smoke stack. Thus the hazardous materials can be rapidly processed and decomposed and vitrifying for storing.

4. After high temperature burning, the general toxic materials have only a small amount of dioxin residue remaining to be treated. Thus the invention can decompose and vitrify toxic materials for storing, or recycle and reclaim the toxic materials to become environment-friendly gravel and building material.

What is claimed is:

1. A resources reclaiming apparatus comprising a furnace which has a spacer in the interior, the spacer having one end forming an arched section which has a distal end tilted upwards to form a sloped section that has one end extended outwards to form a plane spacer which has a firing port formed therein thereby to divide the furnace into a combustion chamber and a second combustion chamber, the furnace further having intake ports on a right side abutting an upper end and air ducts above the intake ports, the air ducts having one end extended into one side of one end of a scattering and dispensing chamber, materials conveyed to the scattering and dispensing chamber and dispensed into the combustion chamber of the furnace through the air ducts to be burned at high temperature and molted to a desired condition, fire being channeled to the arched section and sloped section of the spacer to be directed upwards to aid circulation to lengthen the burning period.

2. The resources reclaiming apparatus of claim 1 further having a discharge device located at the bottom of one end of the furnace and driven by an oil pressure cylinder to tilt and adjust the furnace to a desired angle.

* * * * *